US005896758A

United States Patent [19]

Rock et al.

[11] Patent Number: 5,896,758

[45] Date of Patent: Apr. 27, 1999

[54] THREE-DIMENSIONAL KNIT SPACER FABRIC FOR FOOTWEAR AND BACKPACKS

[75] Inventors: Moshe Rock, Andover, Mass.; Karl Lohmueller, Hampstead, N.H.

[73] Assignee: Malden Mills Industries, Inc., Lawrence, Mass.

[21] Appl. No.: 08/839,297

[22] Filed: Apr. 17, 1997

[51] Int. Cl.[6] ..... D04B 7/12

[52] U.S. Cl. ..... 66/191; 66/194; 66/195

[58] Field of Search ..... 66/169 R, 170, 66/171, 190, 191, 192, 193, 195, 196, 202; 442/307, 312, 313, 314, 318; 36/43, 44

[56] References Cited

U.S. PATENT DOCUMENTS

| | | | |
|---|---|---|---|
| 4,785,558 | 11/1988 | Shiomura | 66/196 |
| 4,787,219 | 11/1988 | Sato et al. | 66/190 |
| 4,813,161 | 3/1989 | Lesley | 36/44 |
| 5,312,667 | 5/1994 | Lumb et al. . | |
| 5,344,698 | 9/1994 | Rock et al. . | |
| 5,385,036 | 1/1995 | Spillane et al. . | |
| 5,413,837 | 5/1995 | Rock et al. . | |
| 5,514,428 | 5/1996 | Kunert . | |
| 5,547,722 | 8/1996 | Rock et al. . | |
| 5,651,847 | 7/1997 | Loeffler | 66/196 |

FOREIGN PATENT DOCUMENTS

| | | |
|---|---|---|
| 0692563 | 7/1996 | European Pat. Off. . |
| WO 9516416 | 6/1995 | WIPO . |

*Primary Examiner*—William Stryjewski
*Assistant Examiner*—Larry D. Worrell, Jr.
*Attorney, Agent, or Firm*—Gottlieb, Rackman & Reisman, P.C.

[57] ABSTRACT

An integrated three-dimensional knit spacer fabric is provided. The fabric includes a first fabric layer, a second fabric layer, and a resilient yarn interconnecting the two layers. The first fabric layer is made from fiber rendered hydrophilic, while the second fabric layer is abrasion resistant.

18 Claims, 1 Drawing Sheet

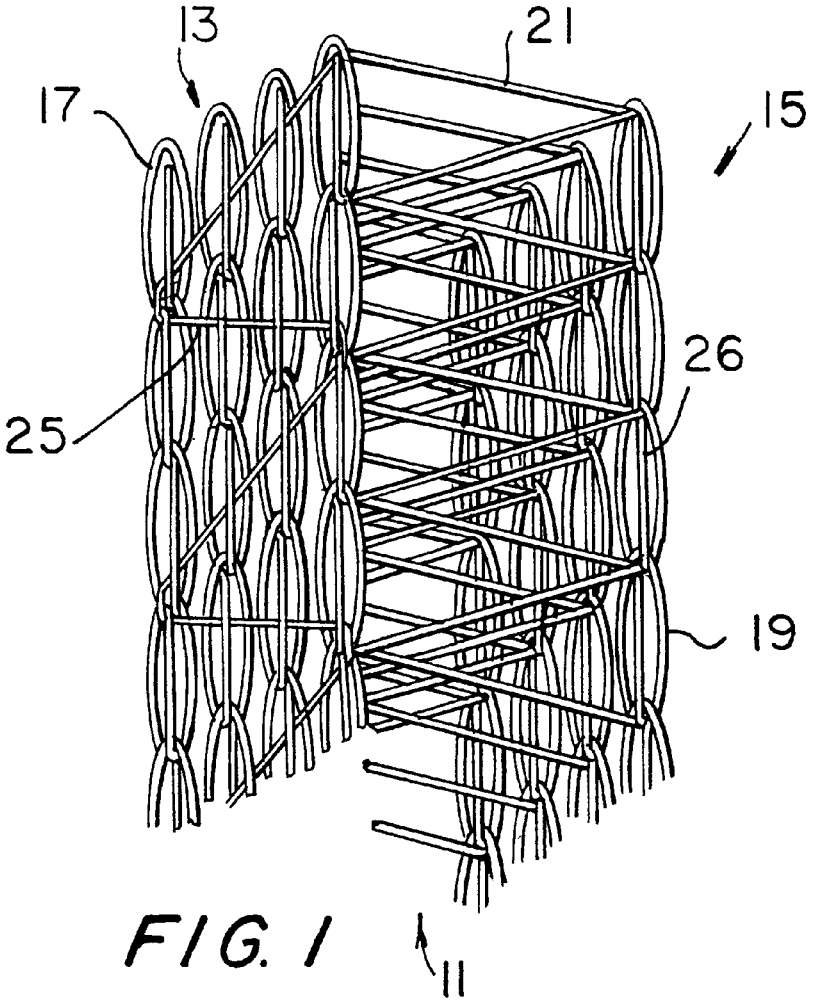
FIG. 1
FIG. 2
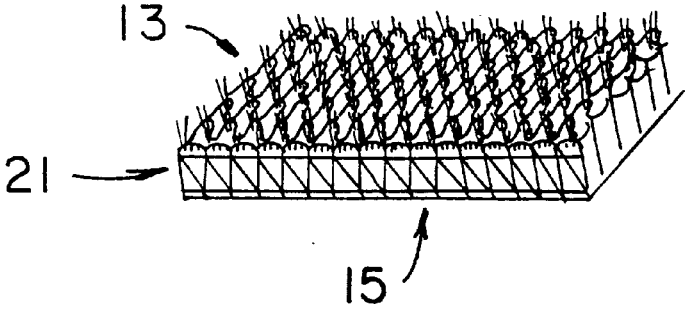

THREE-DIMENSIONAL KNIT SPACER FABRIC FOR FOOTWEAR AND BACKPACKS

BACKGROUND OF THE INVENTION

This invention relates to a three-dimensional knit or woven fabric for footwear and backpacks, and more particularly, to a three-dimensional knit or woven fabric having first and second fabric layers spaced from, and connected to, each other.

Prior art footwear and backpack fabrics are generally comprised of a non-integrated, composite fabric with a laminate applied thereto, the laminate acting as a moisture barrier, hindering transport and evaporation of moisture.

Accordingly, it is desirable to provide a fabric which overcomes the above disadvantages.

SUMMARY OF THE INVENTION

Generally speaking, in accordance with the invention, an integrated composite three-dimensional knit spacer fabric is provided. The fabric includes a first fabric layer, a second fabric layer, and a resilient yarn interconnecting the two layers. The first fabric layer is made from fiber rendered hydrophilic, while the second fabric layer is abrasion resistant.

The three-dimensional spacer fabric of the invention may be used for footwear and backpacks. In all uses, the fabric is constructed such that the bulk ratio of the stitch and pile yarns is controlled.

It is significant that the knit fabric of the invention has a three-dimensional structure. Because of this construction, the fabric acts to cushion the load and protect the wearer.

Accordingly, it is an object of the invention to provide an improved fabric construction for enhancing the transport of body fluids.

Another object of the invention is to provide an improved three-dimensional fabric which is sufficiently resilient.

Another object of the invention is to provide a three-dimensional fabric which functions as a spacer fabric.

Still other objects and advantages of the invention will in part be obvious, and will in part be apparent from the following description.

The invention accordingly comprises the construction having the features, properties and relation of components, as exemplified in the following detailed disclosure, and the scope of the invention will be indicated in the claims.

BRIEF DESCRIPTION OF THE DRAWINGS

For a fuller understanding of the invention, reference is made to the following description, taken in connection with the attached drawings, in which:

FIG. 1 is a side elevational view showing the loop structure of the spacer fabric made in accordance with the invention; and FIG. 2 is a side view of the inventive spacer fabric showing the nap face of the top fabric layer.

DETAILED DESCRIPTION OF THE PREFERRED EMBODIMENT

The double-face fabric of the invention is prepared by knitting a three-dimensional knit fabric on a double-needle bar warp knitting machine commonly used in the manufacture of velvet and well known in the art. As shown in FIGS. 1 and 2, the three-dimensional knit spacer fabric is generally indicated at 11 and includes a first fabric layer 13 made from stitch yarn 17, a second fabric layer 15 made from stitch yarn 19, and pile yarn 21 interconnecting the two layers. In addition, knit fabric 11 includes backing or lay-in yarns 25 and 26 which are held by stitch yarns 17 and 19 respectively as shown.

In preparing the three-dimensional knit fabric of the invention, the yarn that is used is preferably a synthetic material such as polyester, acrylic or nylon. The yarn may be filament or spun, textured or fully oriented.

The yarn interconnecting the two layers of the inventive three-dimensional knit spacer fabric should have sufficient resilience and stiffness to keep the two fabric layers apart even if pressure is applied to any one of the fabric layers. In construction, the interconnecting pile than that of the two fabric layers. Particularly, in order to render the interconnecting pile yarn resilient, the yarn may be made of a resilient material such as monofilament or multifilament polyester, nylon, etc.

The fabric is designed to facilitate moisture transport away from the body, while maintaining a comfortable top layer and air circulation next to the skin. Top layer 13 is made from fibers rendered hydrophilic to make sure that all moisture is transported through it, thus keeping its surface dry.

In particular, first fabric or top (back) layer 13 is made from a stitch yarn 17 having a fineness of between 300 and 600 denier with an individual fiber fineness in the range of between 0.3 and 2.5 dpf. The backing or lay-in yarn 25 of top layer 13 will be multifilament and will have a fineness of between 70 and 200 denier, with an individual fiber fineness of 0.5 to 5 dpf.

Preferably, stitch yarn 17 and backing yarn 25 of first fabric layer 13 are made of polyester or nylon that has been rendered hydrophilic in order to enhance the transport of perspiration and thereby maintain the skin surface dry. Particularly, layer 13 is chemically treated or utilizes modified fibers so that it is rendered hydrophilic, as described in U.S. Pat. No. 5,312,667 which is hereby incorporated by reference.

By using a chemically modified fiber or by chemically treating layer 13, the layer is rendered substantially hydrophilic. As a result, the transport of perspiration from the surface, especially if the yarn fibers of layer 13 are raised, as described hereinbelow, is substantially enhanced—liquid moisture is made readily transportable along the surface of the yarn fibers of layer 13.

Preferably, the surface of fabric layer 13 is sanded, brushed or napped and thus comprises a raised surface fabric, with each fiber end being a conductor of moisture. Thus, fabric layer 13 will include a plurality of fibers for conducting perspiration therealong from the skin of the wearer and eventually to second fabric layer 15, from where it is evaporated.

Pile yarn 21 which interconnects the two layers may be a monofilament or multifilament yarn having a fineness of between 40 and 150 denier, with an individual fiber fineness of 2 to 12 dpf when multifilament. It is preferred, however, that the pile yarn be monofilament in order to increase resilience. The pile yarn is made from fiber rendered hydrophilic in order to facilitate the transport of moisture from top layer 13 to layer 15. Moreover, each of pile yarns 21 is sufficiently spaced from one another to allow air flow throughout fabric 11—this improves cushioning, ventilation and moisture vapor transmission as well as providing for physical protection from objects such as pebbles.

Outside or back fabric layer 15 is made from stitch yarn 19 having a fineness of 150 to 300 denier with an individual fiber fineness of 3.0 to 12 dpf. Backing or lay-in yarn 26 will also have a fineness of from 150 to 300 denier with an individual fiber fineness of 3.0 to 12 dpf.

Both stitch yarn 19 and backing yarn 26 will either be multi- or monofilament, with a high tenacity value in order to increase toughness. In particular, each of the yarns 19 and 26 will have a tenacity of between about 6 and 12 grams per denier. This level of tenacity improves abrasion, tear and rupture resistance of fabric layer 15.

Optionally, the fabric of the invention may incorporate an elastomeric yarn such as LYCRA in one or both of lay-in yarns 25 and 26 of layers 13 and 15 respectively. Such wrap yarn will have a total fineness of between about 70 denier and 200 denier of wrap LYCRA. This will enhance the softness and flexibility of the layers, and the tightness of fit. The elastomeric yarn may also be added to the stitch yarn of each layer.

It will thus be seen that the objects set forth above, and those made apparent from the preceding description, are efficiently attained, and since certain changes may be made in the constructions described above without departing from the spirit and scope of the invention, it is intended that all matter contained in this description shall be interpreted as illustrative and not in a limiting sense.

It is also to be understood that the following claims are intended to cover all of the generic and specific features of the invention herein described, and all statements of the scope of the invention which come as a matter of language, might be said to fall therebetween.

We claim:

1. A three-dimensional knit spacer fabric comprising:

a first fabric layer made from a first stitch yarn and a first backing yarn;

a second fabric layer made from a second stitch yarn and a second backing yarn; and a resilient pile yarn interconnecting said first and second layers;

wherein at least one of said first stitch yarn and said first backing yarn has been rendered hydrophilic, and at least one of said second stitch yarn and said second backing yarn has a tenacity of between about 3 and 12 grams per denier;

wherein said first stitch yarn has a fineness of between about 300 and 600 denier and said pile yarn has a fineness of between about 40 and 150 denier.

2. The fabric of claim 1, wherein at least one of the yarns of said first layer is chemically treated to render the yarn hydrophilic.

3. The fabric of claim 1, wherein said first fabric layer has a surface with yarn fibers that are raised.

4. The fabric of claim 1, wherein said fibers are raised by one of sanding, napping or brushing.

5. The fabric of claim 1, wherein said second stitch yarn has a fineness of between about 150 and 300 denier and a tenacity of between 3 and 12 grams per denier.

6. The fabric of claim 1, wherein the stitch yarn is coarser in the second layer than in the first layer.

7. The fabric of claim 1, wherein said pile yarn is monofilament.

8. The fabric of claim 1, wherein at least one of said backing yarns includes an elastomeric yarn incorporated therein.

9. The fabric of claim 1, wherein said pile yarn is sufficiently spaced in order to allow air flow through the fabric.

10. A three-dimensional knit spacer fabric comprising:

a first fabric layer made from a first stitch yarn and a first backing yarn, said first layer having a raised surface;

a second fabric layer made from a second stitch yarn and a second backing yarn, and a resilient pile yarn interconnecting said first and second layers;

wherein at least one of said first stitch yarn and said first backing yarn has been rendered hydrophilic, and wherein said stitch yarn has a fineness of between about 300 and 600 denier and said pile yarn has a fineness of between about 40 and 150 denier.

11. The fabric of claim 10, wherein said first stitch yarn has an individual fiber fineness in an amount between about 0.3 and 2.5 dpf.

12. The fabric of claim 10 wherein said first backing yarn has a fineness of between about 70 and 200 denier.

13. The fabric of claim 12, wherein said first backing yarn has an individual fiber fineness of between about 0.5 and 5 dpf.

14. The fabric of claim 10, wherein said pile yarn has an individual fiber fineness of between about 2 and 12 dpf when multifilament.

15. The fabric of claim 10, wherein said pile yarn is monofilament.

16. The fabric of claim 10, wherein said pile yarn is rendered hydrophilic in order to facilitate the transport of moisture from between said first fabric layer and said second fabric layer.

17. The fabric of claim 10, wherein both said second stitch yarn and said second backing yarn has a fineness of between about 150 and 300 denier.

18. The fabric of claim 17, wherein each of said second stitch yarn and said second backing yarn have an individual fiber fineness of between about 3.0 and 12 dpf.

* * * * *